US005213274A

United States Patent [19]

Lodovico

[11] Patent Number: 5,213,274

[45] Date of Patent: May 25, 1993

[54] FEEDING MECHANISM FOR A CONTAINER CUTTING MACHINE

[75] Inventor: Frank J. Lodovico, Delmont, Pa.

[73] Assignee: Allegheny Paper Shredders, Inc., Delmont, Pa.

[21] Appl. No.: 877,760

[22] Filed: May 4, 1992

[51] Int. Cl.[5] ..... B02C 19/14; B02C 23/02

[52] U.S. Cl. ..... 241/222; 198/624

[58] Field of Search ..... 241/222, 99, 236; 198/620, 624, 625

[56] References Cited

U.S. PATENT DOCUMENTS

| | | | |
|---|---|---|---|
| 2,622,550 | 12/1952 | Ritchie | 198/624 X |
| 3,117,735 | 1/1964 | Fourey | 241/154 |
| 3,587,981 | 6/1971 | Unterstenhoefer | 241/29 |
| 3,687,062 | 8/1972 | Frank | 100/91 |
| 3,830,355 | 8/1974 | Veriux | 198/624 |
| 4,015,782 | 4/1977 | Granite | 241/222 |
| 4,084,496 | 4/1978 | Ehernberger | 100/35 |
| 4,231,463 | 11/1980 | Vamvakas | 198/624 X |
| 4,402,464 | 9/1983 | Shire et al. | 241/73 |
| 4,703,899 | 11/1987 | Lodovico | 241/99 |
| 4,871,118 | 10/1989 | Maloney | 241/99 |
| 4,884,386 | 12/1989 | Carlo | 53/438 |
| 4,923,126 | 9/1990 | Lodovico et al. | 241/30 |
| 5,169,078 | 12/1992 | Lamar | 241/222 |

*Primary Examiner*—Douglas D. Watts

*Attorney, Agent, or Firm*—James L. Sherman

[57] ABSTRACT

A feeding mechanism is for feeding cylindrical containers having a diameter and a major length dimension to a cutting machine and includes a pair of parallel feed shafts centrally disposed above the cutting machine. The feed shafts have parallel axes of rotation for rotation in opposite directions. The feed shafts have a predetermined distance therebetween to provide a predetermined gap between the feed shafts which is greater than the diameter of the cylindrical container. Each of the feed shafts includes a pair of feed discs mounted for rotation therewith. The pair of feed discs on each shaft include corresponding curved sectors which cooperate with corresponding curved sectors of the pair of feed discs on the other shaft for gripping the sides of the container therebetween. Rotation of the shafts toward the cutting machine causes the container entrapped by the corresponding curved sectors to be fed in an end first direction toward the cutting machine.

17 Claims, 3 Drawing Sheets

FEEDING MECHANISM FOR A CONTAINER CUTTING MACHINE

BACKGROUND OF THE INVENTION

1. Field of Invention

This invention relates to a feeding machanism for a container cutting machine and, more specifically, to such a feeding mechanism which can direct cylindrical containers toward the cutting machine for cutting the cylindrical containers into small pieces thereby.

2. Description of the Prior Art

U.S. Pat. No. 4,923,126, entitled "Machine For Cutting Disposable Containers" by Frank J. Lodovico and John W. Wagner and patented on May 8, 1990, is incorporated by reference as if included in its entirety herein. The cutting machine diclosed therein is capable of cutting into small pieces the thin wall material of a plurality of disposable cotainers such as plastic bottles and/or metal cylindrical cans. These cutting machines are typically used to cut the plastic bottles and/or metal cans of the type used in the soft drink industry. The bottles or cans are returned for deposit and individually cut into small pieces for collection and disposition. The cutting section of the machine includes a pair of parallel shafts mounted for rotation in opposite directions about the center axes thereof. Each of the shafts rigidly supports a plurality of overlapping cutting wheels for rotation therewith. Each cutting wheel preferably has a plurality of identical cutting teeth with each tooth having an apex at the maximum diameter and a root at a root diameter of the cutting wheel. Each cutting tooth has a leading surface and a trailing surface which meet at the apex to form a straight edge at the maximum diameter which is parallel to the center axis of the shaft. The leading surface and the trailing surface respectively lie in planes which are parallel with the center axis of the shaft and extend toward the same side thereof to cause the straight edge of the apex to circumferentially lead a remainder of the leading surface during rotation of the cutting wheel.

The basic cutting wheel configuration has been found to effectively and reliably produce the small pieces of the containers as disclosed therein. Generally, the embodiment in U.S. Pat. No. 4,923,126 is configured to cause most of the small pieces to be ejected downwardly from the cutting area between the cutting wheels. A dispersing section below the cutting area is intended to disperse the small pieces throughout a collecting section therebelow. The small pieces are received within a container in the collecting section and eventually removed for further disposition. However, it has been found that suctioning or vacuuming means disposed in the lower area of the machine is preferred in order to transport the small pieces to a larger container remote from the machine itself. In either case, it is clearly desirable that all of the containers be completely cut into the small pieces and that the small pieces produced in the cutting section be discharged from the cutting area and collected or transported for further disposition.

As discussed in U.S. Pat. No. 4,923,126, such machines are typically utilized for cutting disposable containers employed in the soft drink industry. As a result, there have been continuing problems with the cutting of such disposable containers which have not typically existed in the operation of other types of cutting machines found in the prior art. The soft drink liquid remaining in the disposable containers has been found, in a short time of operation, to completely engulf the interior of the container cutting machine. The liquid is extremely corrosive and the sugary substance can cause even greater problems when heated. Additionally, because the soft drink liquid is deposited on many of the small pieces produced by the cutting machine, the small pieces also become sticky.

U.S. Pat. No. 4,703,899, entitled "Feeding Device For A Container Cutting Machine" by Frank J. Lodovico and patented on Nov. 3, 1987, dicloses a typical mechanism which can be utilized for feeding plastic bottles and/or metal cans to the type of cutting machine disclosed in U.S. Pat. No. 4,923,126. U.S. Pat. No. 4,703,899 is incorporated by reference as if included in its entirety herein.

The feeding device disclosed in U.S. Pat. No. 4,703,899 primarily dicusses various size plastic bottles which can be directed to the cutting section of the machine thereof. However, the same feeding device has heretofore been successfully employed for the feeding of cans to a cutting section. Generally, the cutting machines of U.S. Pat. No. 4,923,126 for cutting large plastic bottles or for cutting small metal cans used in the soft drink industry are identical except for the effective width of the machines as determined by the effective length of the cutting shafts. In other words, if the machine is intended to cut metal cans, the effective length of the cutting shafts is about 5.625 inches while the effective length of the cutting shafts of the machine which is intended to cut plastic bottles would be about 8 inches. The smaller machine simply includes a lesser number of identically sized cutting wheels on the shafts thereof. Similarly, if the machine is intended to cut smaller metal cans, the overall length of the paddles of the feeding device would be of a comparable smaller length.

Although the cutting machine of U.S. Pat. No. 4,923,126 typically produced the desired small pieces of plastic bottles and/or metal cans for disposition therebelow, with the advent of a suctioning or vacuuming means for transporting these smaller pieces to a different location, new problems were experienced. For example, when collecting small pieces below the cuttting section, the inclusion of larger pieces in the form of elongated strips, rather than the specifically intended small pieces, was of no particular concern. The primary objective of cutting the plastic bottles and/or metal cans into small pieces was to effectively reduce the volume of the material for collection and further disposition. If a few elongated strips which were not reduced to small pieces were present, the volume was still effectively reduced.

On the other hand, with the advent of the improved suctioning or vacuuming means for further disposition of the smaller pieces, there is a significant concern that all of the plastic bottles and/or metal cans be cut into the desired small pieces rather than including any elongated strips. The elongated strips tend to interfere with the suctioning or vacuuming of the small pieces to a remote location. This problem of interference by the elongated strips is complicated by the existance of the sticky, sugary substance on both the small pieces and the elongated strips.

Specifically, the overall configuration of the prior art feeding device and cutting machine is such that those portions of the plastic bottle and/or metal cans which are cut by the cutting wheels located at the ends of the cutting shaft would produce the elongated strips of the thin wall material rather than the desired small pieces. Accordingly, while the feeding device of U.S. Pat. No. 4,703,899 can effectively direct plastic bottles and/or metal cans to the cutting section to be generally cut thereby, there is no assurance that the plastic bottles and/or metal cans will be directed toward and confined to a central area of the cutting section to insure that the entire container will be cut into the desired small pieces.

Accordingly, there remains a need for a feeding mechanism which will insure that the cylindrical containers are directed toward the center of the cutting section so that no portion of the containers will be cut by the cutting wheels located at the end thereof.

SUMMARY OF THE INVENTION

It is therefore an object of the invention to provide a feeding mechanism for feeding cylindrical containers or the like to a cutting machine with the container being directed to the central area of the cutting machine.

It is another object to provide such a feeding mechanism which is reliable to operate and insures that the cylindrical container will be directed end first to the central area of the cutting machine for the cutting of the container into a plurality of small pieces.

These and other objects of the invention are provided in a preferred embodiment thereof including a feeding mechanism for feeding cylindrical containers or the like through a cutting machine of a type for cutting a thin wall material of the cylindrical containers into small pieces. The cylindrical container has a length and a diameter with the length being greater than the diameter. The feeding machanism is for first directing a leading end of the cylindrical container toward the cutting machine for initial cutting thereby. The cutting machine has an effective width greater than the diameter of the container. The feeding mechanism includes a pair of parallel feed shafts centrally disposed above the cutting machine. Each of the feed shafts has an axis of rotation. The axes of rotation are parallel and disposed an equal distance above the cutting machine. The feed shafts have a predetermined shaft distance therebetween to provide a predetermined gap between the feed shafts. The predetermined gap is greater than the diameter of the cylindrical container. Each feed shaft has a pair of feed discs mounted for rotation therewith. Each feed disc has a central area and a peripheral area. The pair of feed discs are mounted on the feed shaft with the central areas having a first predetermined distance therebetween. The peripheral areas include a plurality of first curved sectors and a plurality of second curved sectors. Circumferentially adjacent first curved sectors are separated by one of the second curved sectors therebetween. The first curved sectors of the pair of feed discs on each feed shaft are circumferentially aligned on the feed shaft. The second curved sections of the pair of feed discs on each feed shaft are circumferentially aligned on the feed shaft. The pair of feed shafts are mounted for rotation in opposite directions and at the same speed toward the cutting machine. The pair of feed shafts are rotationally aligned to cause the first curved sectors and the second curved sectors on the respective feed shafts to be aligned when positioned between the feed shafts. Corresponding first curved sectors of the feed discs on each feed shaft are a second predetermined distance apart. Corresponding second curved sectors of the feed discs on each feed shaft are a third predetermined maximum distance apart. The second predetermined distance is greater than the first predetermined distance and less than the diameter of the container. The third predetermined maximum distance is greater than the diameter. The pair of feed discs on one of the feed shafts cooperates with the pair of feed discs on the other of the feed shafts to entrap the cylindrical containers generally between the corresponding first curved sectors of the pair of feed discs on one feed shaft and aligned corresponding first curved sectors of the pair of feed discs on the other of the feed shafts for advancement of the leading end of the cylindrical container toward the cutting machine.

In the preferred feeding mechanism, the predetermined shaft distance is about twice the diameter. The pair of feed discs on each feed shaft are centrally disposed within the effective width of the cutting machine. The effective width of the cutting machine is greater than twice the diameter and the third predetermined maximum distance is less than one-half of the effective width. Each feed disc has an effective radius less than the diameter. The plurality of first curved sectors includes three first curved sectors and the plurality of second curved sectors includes three second curved sectors.

More specifically, a preferred embodiment of the invention includes a feeding mechanism for feeding cylindrical containers or the like through a cutting machine of the type for cutting a thin wall material of cylindrical containers into small pieces, the cutting machine having a pair of parallel cutting shafts mounted for rotation in opposite directions about parallel central axes thereof. Each of the cutting shafts includes a plurality of cutting wheels fixedly mounted for rotation therewith. Each cutting wheel on one of the cutting shafts extends between and axially separates axially adjacent cutting wheels on the other of the cutting shafts. The cylindrical container has a length and a diameter with the length being greater than the diameter. The cutting machine has an effective width greater than the diameter. The feeding mechanism includes a pair of parallel feed shafts centrally disposed above the parallel cutting shafts. Each of the feed shafts has an axis of rotation. Each axis of rotation is parallel with and disposed an equal distance above a corresponding one of the cutting shafts. Each feed shaft is for rotation in the same direction as the corresponding one of the cutting shafts. The pair of feed shafts have a predetermined shaft distance therebetween to provide a predetermined gap between the feed shafts. The predetermined gap is greater than the diameter of the cylindrical container and less than the length of the cylindrical container. Each feed shaft has a pair of feed discs mounted for rotation therewith. Each feed disc has a central area and a peripheral area. The pair of feed discs are mounted on the feed shaft with the central areas having a first predetermined distance therebetween. The peripheral areas include a plurality of first curved sectors and a plurality of second curved sectors. Circumferentially adjacent first curved sectors are separated by one of the second curved sectors therebetween. The first curved sectors of the pair of feed discs on each feed shaft are circumferentially aligned on the feed shaft. The second curved sectors of the pair of feed discs on each feed shaft are circumferentially aligned on the feed shaft. The pair of feed shafts rotate in opposite directions and at the same speed. The pair of feed shafts are rotationally aligned to cause the first curved sectors and the second curved sectors on respective feed shafts to be aligned when positioned between the feed shafts. Corresponding first curved sectors of the pair of feed discs on the feed shaft are a second predetermined distance apart. Corresponding second curved sectors of the pair of feed discs on the feed shaft are a third predetermined maximum distance apart. The second predetermined distance is greater than the first predetermined distance and less than the diameter. The third predetermined maximum distance is greater than the diameter. The pair of feed discs on one of the feed shafts cooperates with the pair of feed discs on the other of the feed shafts to entrap the cylindrical cans generally between the corresponding first curved sectors of the pair of feed discs on the feed shaft and aligned corresponding first curved sectors of the pair of feed discs on the other feed shaft for advancement of the leading end of the cylindrical container toward the cutting wheels for gripping and cutting of the cylindrical container thereby.

The predetermined shaft distance is preferably about twice the diameter. The diameter of the cylindrical container is about 2.5 inches and the predetermined shaft distance is about 5.0 inches. Each feed disc includes an effective radius and the effective radius is less than one-half of the predetermined shaft distance, is less than the diameter, and is preferably about 2.375 inches. The preferred first predetermined distance is about 1.5 inches. With the diameter of the cylindrical container being about 2.5 inches, the second predetermined distance is about 1.875 inches and the third predetermined maximum distance is about 4 inches. There are preferably three first curved sectors and three second curved sectors.

The effective width of the cutting machine is greater than twice the diameter and the third predetermined maximum distance is less than one-half of the effective width. The pair of feed discs on each feed shaft are centrally disposed within the effective width of the cutting machine.

DESCRIPTION OF THE PREFERRED EMBODIMENT

Figure 1:
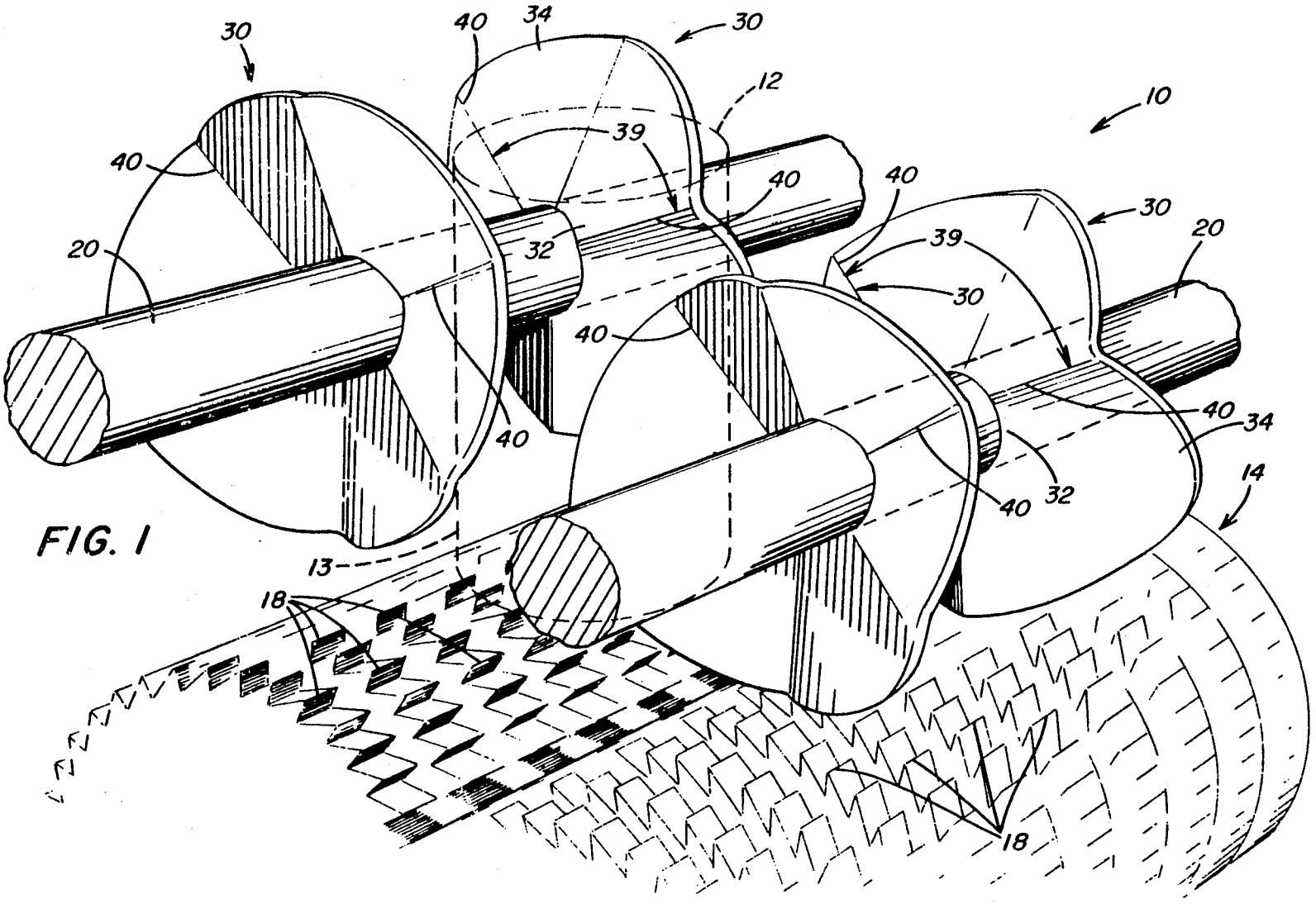
FIG. 1 is a fragmentary isometric view, partially in section, of the preferred feeding mechanism including various features of the invention.

As seen in FIGS. 1 through 4, a preferred feeding mechanism 10 is for feeding metal cylindrical cans 12 or the like through a cutting machine 14 of the type having a pair of parallel cutting shafts 16. The parallel cutting shafts 16 are mounted for rotation in opposite directions about parallel central axes 17 thereof. Each of the cutting shafts 16 includes a plurality of cutting wheels 18 fixedly mounted for rotation therewith. Each cutting wheel 18 on one of the cutting shafts 16 extends between and axially separates axially adjacent cutting wheels 18 on the other of the cutting shafts 16.

The typical metal cylindrical can or container 12 to be cut by the cutting machine 14 includes a length L and a diameter D with the length L being greater than the diameter D and is of the type which is typically found in the soft drink industry. Generally, the preferred feeding mechanism 10 will be seen to be configured to be capable of effectively feeding a first end 13 of a cylindrical container 12 toward a cutting machine 14 for being initially cut thereby. In other words, the preferred feeding mechanism 10 will generally feed the cylindrical container 12 in a longitudinal manner between the cutting shafts 16 and the cutting wheels 18 thereon. It should be understood that the general configuration provided for the preferred feeding mechanism 10 will be capable of feeding any elongated container having a length substantially greater than the diameter thereof in this "end first" manner toward a cutting machine.

It should also be understood that preferred feeding mechanism 10 and cutting machine 14 would preferably be employed in a revised vending machine of the type generally disclosed in U.S. Pat. No. 4,703,899. The revised vending machine generally includes an access door in which the customer will be capable of depositing a bottle or a can depending on which particular machine is being employed. For example, the can must be deposited in a top upwardly or downwardly position depending on the location of the UPC Code. The can is placed in a trough which is positioned generally vertically inside the opening of the revised vending machine. When the access door is closed, the can is caused to rotate by friction wheels mounted in the trough to produce the proper alignment and movement of the can required to electronically read the UPC Code. The reverse vending machine is so configured to provide a proper accounting of the particular can deposited therein in order to verify that the soft drink company will provide the redemption money for the grocery store.

After the UPC Code is properly read the trough is automatically reoriented to cause the can to slide downwardly in an end first position toward the entrance to the cutting section of the cutting machine disposed therein. Gravity alone will not insure that the can will be properly oriented to be gripped by and cut in the cutting section. The can or container falling by gravity can bounce on the upper portion of the cutting wheels or can assume a position on its side which would not prevent the undesired cutting at the cutting wheels located at the ends of the cutting shafts.

Accordingly, as will be seen, the preferred feeding mechanism 10 generally accepts cans or other containers in an "end first" manner. However, the mechanism 10 also includes means for positively feeding the cans in the "end first" manner which would not be obtained by simply allowing gravity to direct the cans or containers to the cutting section. The typical revised vending machine would orient the cylindrical can or container 12 for advancement to the feeding mechanism 10 with the first end 13 being disposed downwardly by gravity, as generally seen in FIGS. 1 through 4, for continued positive feeding to the cutting machine 14.

The feeding mechanism 10 includes a pair of parallel feed shafts 20 which are centrally disposed above the parallel cutting shafts 16. The feed shafts 20 respectively include an axis of rotation 21 which is parallel with and disposed an equal distance above a corresponding one of the cutting shafts 16. Each feed shaft 20 is mounted for rotation in the same direction as its corresponding one of the cutting shafts 16.

Figure 2:
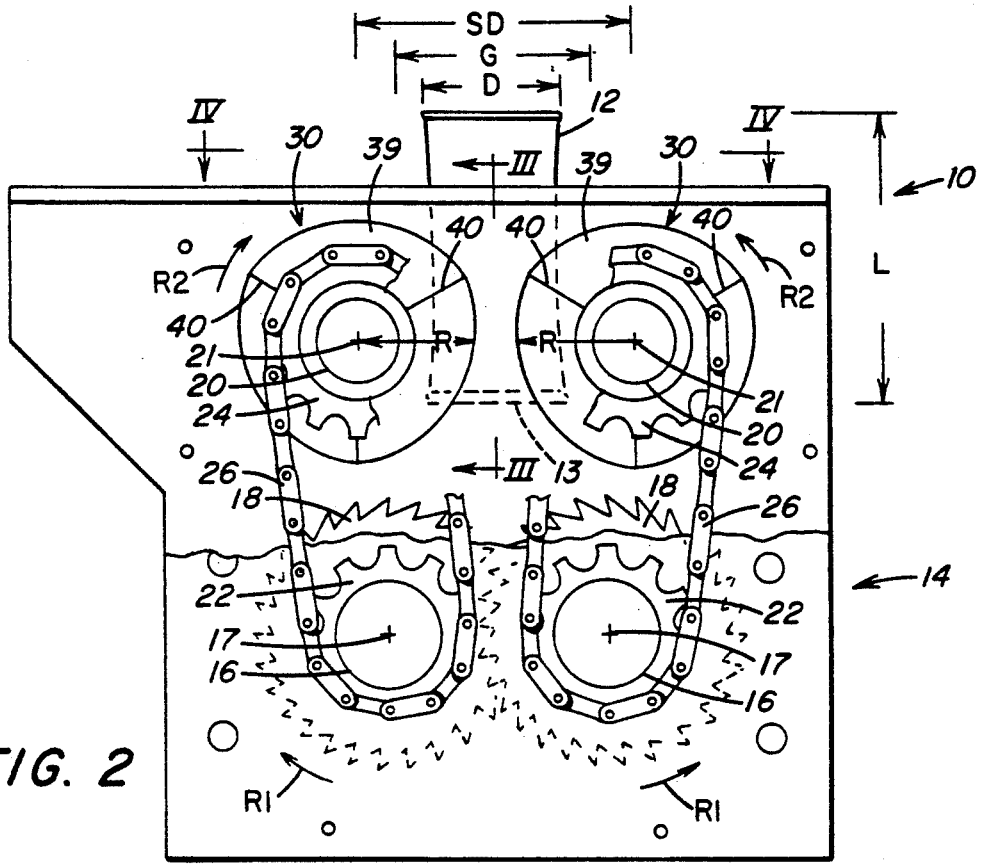
FIG. 2 is a fragmentary, sectional end view of the preferred feeding mechanism including various features of the invention.
Figure 3:
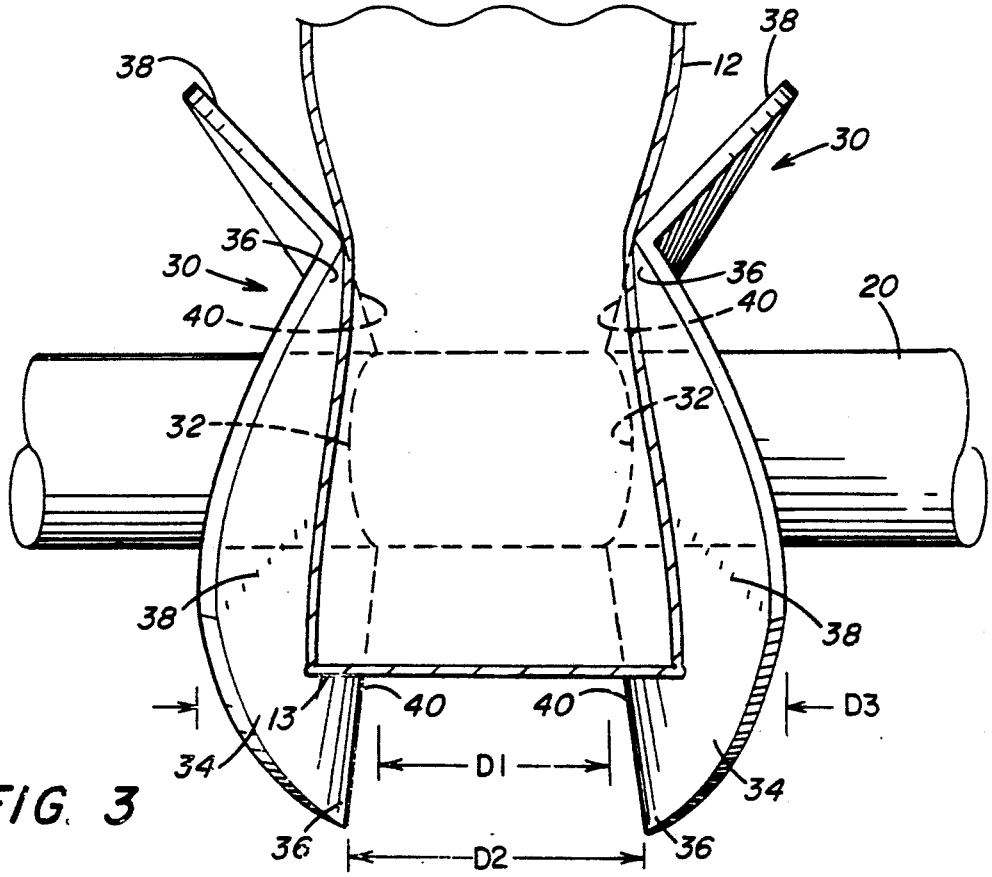
FIG. 3 is a side view of the feeding mechanism as generally seen along line III—III of FIG. 2.
Figure 4:
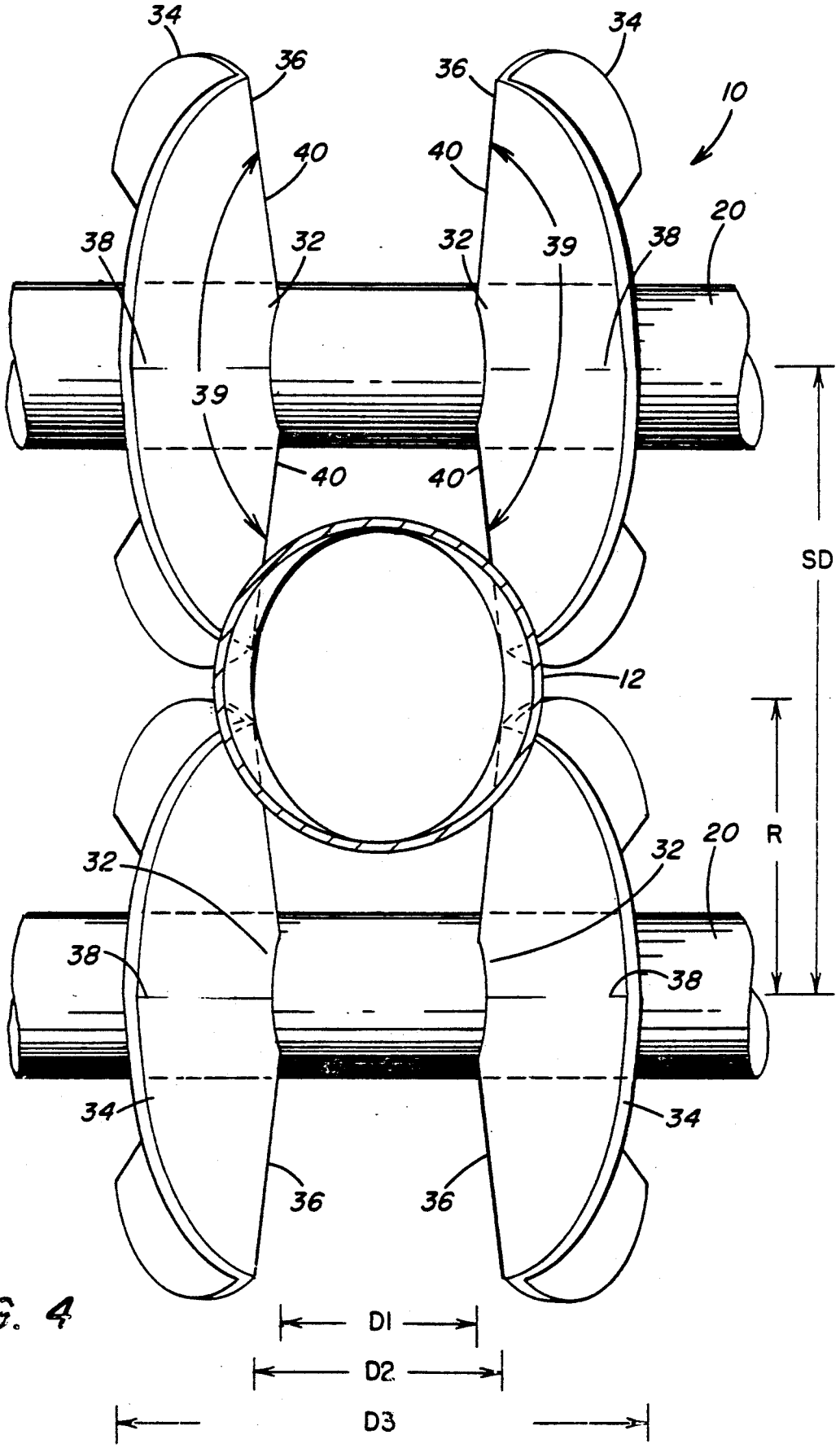
FIG. 4 is a top view of the preferred feeding mechanism as generally seen along line IV—IV of FIG. 2.

As seen in FIG. 2, the rotating cutting shafts 16 preferably include a drive sprocket 22 mounted on one end thereof. The cutting shafts 16 are driven at the opposite end by a motor and reduction gear configuration (not shown) and are geared together for rotation in opposite directions R1 and at the same speed of rotation. Each of the feed shafts 20 includes a driven sprocket 24 mounted on the corresponding end thereof in general alignment with the drive sprockets 22. A chain 26 connected between each drive sprocket 22 and each driven sprocket 24 causes corresponding rotation R2 of the respective feed shafts 20 by the corresponding cutting shafts 16. Generally, the axes of rotation 21 of the feed shafts 20 have a predetermined shaft distance SD therebetween which is greater than the diameter D of the cylindrical can or container 12 and is preferably about twice the diameter D.

Each feed shaft 20 includes a pair of feed discs 30 mounted for rotation therewith. Each feed disc 30 has a central area 32 and a general peripheral area 34. The pair of feed discs 30 are mounted on the feed shafts 20 with the central areas 32 having a first predetermined distance D1 therebetween.

The peripheral area 34 of each feed disc 30 include a plurality of first curved sectors 36 and a plurality of second curved sectors 38. The first curved sectors 36 curve inwardly toward the center of the cutting shafts 20 while the second curved sectors 38 curve outwardly toward the ends of the cutting shafts 20. Each feed disc 30 has an effective radius R which generally locates the first curved sectors 36 and second curved sectors 38 of the peripheral area 34 outwardly of the shafts 20. The preferred radius R is close to but less than the diameter D of the can or container 12.

Circumferentially adjacent first curved sectors 36 of each feed disc 30 are separated by one of the second curved sectors 38 therebetween. More specifically, the respective first curved sectors 36 and second curved sectors 38 are generally curved in opposite directions along the circumference of the feed disc 30. The preferred disc 30 is formed of three basic sectors 39 which are slightly larger than 120 degree sectors of a circular disc. Each of the three basic sectors 39 are bent or curved at the center region thereof and are joined together by being welded at their radial edges 40. The bent or curved center region forms the second curved sector 38. The welded junction of the radial edges 40 of the three basic sectors 39 is at an angle to form each of the first curved sectors 36. Accordingly, while the preferred discs are generally composed of at least three basic sectors 39, it should be understood that only two larger or perhaps four smaller such basic sectors might be employed with curved or bent center regions and edges thereof welding at an angle. On the other hand, it is also possible that with a different form of fabrication, the oppositely curved or bent first sectors 36 and second sectors 38 could be formed in a generally curved or wavy manner without the second sectors being formed from bent planar basic sectors 39 and without the first sectors 36 including the angled configuration resulting from the welding of the adjacent radial edges of the basic sectors 39.

The first curved sectors 36 of the pair of feed disc 30 on each shaft 20 are circumferentially aligned. Similarly, the second curved sectors 38 of the pair of feed discs 30 on each shaft 20 are circumferentially aligned. Generally, the feed shafts 20 are configured to rotate at the same speed and are rotationally aligned to cause the first curved sectors 36 and the second curved sectors 38 on the respective feed shafts 20 to be aligned when positioned between the pair of feed shafts 20.

In order to provide proper spacing for the receipt of a cylindrical can or container 12 therebetween and for feeding the leading end 13 thereof toward the cutting machine 14, there are provided preferred relative dimensions for the cooperating curved sectors 36, 38 of the pair of feed discs 30 on both feed shafts 20. Generally, the corresponding first curved sectors 36 of the pair feed discs 30 on one of the feed shafts 20 are at a second predetermined distance D2 apart. Similarly, the corresponding second curved sectors 38 of the pair of feed discs 30 on one of the feed shafts 20 are at a third predetermined maximum distance D3 apart. Generally, the second predetermined distance D2 is greater than the first predetermined distance D1 and less than the diameter D of the cylindrical container 12. Additionally, the third predetermined maximum distance D3 is greater than the diameter D of the cylindrical container.

Accordingly, the preferred relationship between the second predetermined distance D2 and the third predetermined maximum distance D3 is such that the diameter D of the metal can 12 is dimensionally therebetween. When the leading end 13 of a can or container 12 is first directed between the pair of feed discs 30 on one shaft 20 and the pair of feed discs 30 on the other shaft 20, the leading end 13 of the cylindrical can 12 can be freely positioned between the corresponding second curved sectors 38 of the pair of feed discs 30 of both feed shafts 20. With continued rotation of the feed discs 30, the first curved sectors 36 are brought into alignment with the sides of the can or container 12. With the first curved sectors 36 having therebetween the smaller second predetermined distance D2 which is less than the diameter D, the first curved sectors 36 generally deflect and grip the sides of the can 12 therebetween to feed the can or container 12 to the cutting machine 14. The feed discs 30 on one of the shafts 20 cooperates with the feed discs 30 on the other feed shaft 20 to entrap the cylindrical cans 12 at the sides generally between the corresponding first curved sectors 36 on both shafts 20 for advancement of the first end 13 of the cylindrical can or container 12 toward the cutting machine 14.

With the leading, first end 13 being initially advanced toward the cutting machine 14, the cutting teeth on the cutting wheels 18 tend to grip the end 13 to direct it between the cutting shafts 16. Continued gripping by the cutting teeth causes cutting by the cutting wheels 18 as the entire can 12 is advanced between the feed shafts 16 and cut by the array of overlapping cutting wheels 18 located centrally within the cutting machine 14. More specifically, entrapping the can or container 12 between the cooperating feed discs 30 causes the can or container 12 to the centrally disposed along the cutting shaft 16 so that the can or container 12 is not capable of being positioned toward the ends of the cutting shafts 16. By preventing the can or container 12 from being located at either end of the cutting shafts 16, the cutting wheels 18 at the ends of the cutting shafts 16 are not employed to cut the can or container 12 and thus produce the undesired elongated strips. When the can or container 12 is properly positioned, only the centrally disposed cutting wheels 18 on the cutting shafts 16 will specifically cut the can or container 12. As a result, the centrally disposed cutting wheels 18 will produce the desired small pieces which can then be suctioned or vacuumed for disposition at a remote location.

In order to better understand the preferred feeding mechanism 10, it is appropriate to provide typical dimensions which can be utilized to properly feed a metal, cylindrical can employed in the soft drink industry to a typical cutting machine 14. If a different sized container were to be cut, correspondingly different dimensions would be employed by those skilled in the container cutting art to produce similar results. Although the cylindrical cans have slightly different dimensions, a typical can has a diameter D of about 2.5 inches and a length L of about 5 inches. The cutting machine 14 would have an effective shaft length of about 5.625 inches to include nine cutting wheels on one cutting shaft with ten cutting wheels on the other cutting shaft. The cutting shafts would be disposed with about 4.010 inches therebetween so that there is overlapping of the cutting wheels having a diameter of about 4.875 inches. Each of the cutting wheels would have a thickness or width of about 0.2945 inches. With each cutting wheel having 24 cutting teeth thereon, the small pieces produced by the cutting wheels would be about 0.625 inches long and about 0.2945 inches wide with a characteristic bend or fold in the middle thereof.

The preferred cutting machine and feeding mechanism would be powered by an electric motor having a rating of about two horsepower used in conjunction with a speed reducer to cause the cutting shafts to have a rotation R1 of about 34 RPM. The drive sprockets, having 11 teeth, and the driven sprockets, having 15 teeth, are configured to produce the corresponding rotation R2 of the feed shafts but with a speed of about 25 RPM.

The feed shafts would be disposed to provide a predetermined shaft distance SD of about 5 inches.

With each feed shaft having a diameter of about two inches, the gap G between the feed shafts is about three inches. The gap G must be greater than the diameter D of each can 12 to facilitate the passages of the cans 12 therebetween. The effective radius R of each feed disc would be about 2.375 inches. The preferred first predetermined distance D1 would be about 1.5 inches. The second predetermined distance D2 would be about 1.875 inches with the third predetermined maximum distance being about 4.0 inches.

While the specific dimensions provided hereinabove are preferred to advance the typical cylindrical containers found in the soft drink industry, it should be clear that other alterations could be made to the preferred embodiment without departing from the scope of the invention as claimed. Similarly, slight variations in the relative dimensions could be employed while still advancing the cylindrical container toward the cutting machine in the manner as claimed. For example, while the preferred dimensions are given in terms of "about" specific inches or fractions of inches, it should be understood that the dimensions might be varied by an amount plus or minus 0.10 inches without adversely affecting the operation or reliability of the preferred feeding mechanism. Clearly, minor dimensional changes could be employed by one skilled in the art without departing from the scope of the invention as claimed.

What is claimed is:

1. A feeding mechanism for feeding cylindrical containers or the like through a cutting machine of a type for cutting a thin wall material of said cylindrical containers into small pieces, said cylindrical container having a length and a diameter, said length being greater than said diameter, said feeding mechanism for first directing a leading end of said cylindrical container toward said cutting machine for initial cutting thereby, said cutting machine having an effective width greater than said diameter, said feeding mechanism comprising:

a pair of parallel feed shafts centrally disposed above said cutting machine;

each of said feed shafts having an axis of rotation;

said axes of rotation being parallel and disposed an equal distance above said cutting machine;

said pair of said feed shafts having a predetermined shaft distance therebetween to provide a predetermined gap between said feed shafts;

said predetermined gap being greater than said diameter of said cylindrical container;

said each feed shaft having a pair of feed discs mounted for rotation therewith;

said each feed disc having a central area and a peripheral area;

said pair of said feed discs being mounted on said feed shaft with said central areas having a first predetermined distance therebetween;

said peripheral areas including a plurality of first curved sectors and a plurality of second curved sectors;

circumferentially adjacent said first curved sectors being separated by one of said second curved sectors therebetween;

said first curved sectors of said pair of said feed discs on said each feed shaft being circumferentially aligned on said each feed shaft;

said second curved sectors of said pair of said feed discs on said each feed shaft being circumferentially aligned on said each feed shaft;

said pair of said feed shafts being mounted for rotation in opposite directions and at the same speed toward said cutting machine;

said pair of said feed shafts being rotationally aligned to cause said first curved sectors and said second curved sectors on respective said feed shafts to the aligned when positioned between said feed shafts;

corresponding said first curved sectors of said pair of said feed discs on said feed shaft being a second predetermined distance apart;

corresponding said second curved sectors of said pair of said feed discs on said feed shaft being a third predetermined maximum distance apart;

said second predetermined distance being greater than said first predetermined distance and less than said diameter;

said third predetermined maximum distance being greater than said diameter; and said pair of said feed discs on one of said feed shafts cooperating with said pair of said feed discs on the other of said feed shafts to entrap said cylindrical containers generally between said corresponding first curved sectors of said pair of said feed discs on said one feed shaft and aligned said corresponding first curved sectors of said pair of said feed discs on said other of said feed shafts for advancement of said leading end of said cylindrical container toward said cutting machine.

2. The feeding mechanism according to claim 1, wherein said predetermined shaft distance is about twice said diameter.

3. The feeding mechanism according to claim 1, wherein said pair of said feed discs on said each feed shaft are centrally disposed within said effective width of said cutting machine.

4. The feeding mechanism according to claim 1, wherein said effective width of said cutting machine is greater than twice said diameter and said third predetermined maximum distance is less than one-half of said effective width.

5. The feeding mechanism according to claim 1, wherein said each feed disc has an effective radius less than said diameter.

6. The feeding mechanism according to claim 1, wherein said plurality of said first curved sectors includes three said first curved sectors and said plurality of said second curved sectors includes three said second curved sectors.

7. A feeding mechanism for feeding cylindrical containers or the like through a cutting machine of the type for cutting a thin wall material of said cylindrical containers into small pieces, said cutting machine having a pair of parallel cutting shafts mounted for rotation in opposite directions about parallel central axes thereof, each of said cutting shafts including a plurality of cutting wheels fixedly mounted for rotation therewith, each said cutting wheel on one of said cutting shafts extending between and axially separating axially adjacent said cutting wheels on the other of said cutting shafts, said cylindrical container having a length and a diameter, said length being greater than said diameter, said cutting machine having an effective width greater than said diameter, said feeding mechanism comprising:

a pair of parallel feed shafts centrally disposed above said cutting machine;

each of said feed shafts having an axis of rotation;

each said axes of rotation being parallel and disposed an equal distance above a corresponding one of said cutting shafts, said each feed shaft being for rotation in the same direction as said corresponding one of said cutting shafts, said pair of said feed shafts having a predetermined shaft distance therebetween to provide a predetermined gap between said feed shafts;

said predetermined gap being greater than said diameter of said cylindrical container and less than said length of said cylindrical container;

said each feed shaft having a pair of feed discs mounted for rotation therewith;

said each feed disc having a central area and a peripheral area;

said pair of said feed discs being mounted on said feed shaft with said central areas having a first predetermined distance therebetween;

said peripheral areas including a plurality of first curved sectors and a plurality of second curved sectors;

circumferentially adjacent said first curved sectors being separated by one of said second curved sectors therebetween;

said first curved sectors of said pair of said feed discs on said each feed shaft being circumferentially aligned on said each feed shaft;

said second curved sectors of said pair of said feed discs on said each feed shaft being circumferentially aligned on said each feed shaft;

said pair of said feed shafts being mounted for rotation in opposite directions and at the same speed;

said pair of said feed shafts being rotationally aligned to cause said first curved sectors and said second curved sectors on respective said feed shafts to be aligned when positioned between said feed shafts;

corresponding said first curved sectors of said pair of said feed discs on said feed shaft being a second predetermined distance apart;

corresponding said second curved sectors of said pair of said feed discs on said feed shaft being a third predetermined maximum distance apart;

said second predetermined distance being greater than said first predetermined distance and less than said diameter;

said third predetermined maximum distance being greater than said diameter; and said pair of said feed discs on one of said feed shafts cooperating with said pair of said feed discs on the other of said feed shafts to entrap said cylindrical containers generally between said corresponding first curved sectors of said pair of said feed discs on said one feed shaft and aligned said corresponding first curved sectors of said pair of said feed discs on said other of said feed shafts for advancement of said leading end of said cylindrical container toward said cutting wheels for gripping and cutting of said cylindrical container thereby.

8. The feeding mechanism according to claim 7, wherein said predetermined shaft distance is about twice said diameter.

9. The feeding mechanism according to claim 8, wherein said diameter of said cylindrical container is about 2.5 inches and said predetermined shaft distance is about 5.0 inches.

10. The feeding mechanism according to claim 9, wherein said each feed disc includes an effective radius and said effective radius in less than one-half of said predetermined shaft distance.

11. The feeding mechanism according to claim 10, wherein said effective radius is about 2.375 inches.

12. The feeding mechanism according to claim 10, wherein said first predetermined distance is about 1.5 inches.

13. The feeding mechanism according to claim 7, wherein said diameter of said cylindrical container is about 2.5 inches, said second predetermined distance is about 1.875 inches, and said third predetermined maximum distance is about 4 inches.

14. The feeding mechanism according to claim 7, wherein said plurality of said first curved sectors includes three said first curved sectors and said plurality of said second curved sectors includes three said second curved sectors.

15. The feeding mechanism according to claim 7, wherein said effective width of said cutting machine is greater than twice said diameter and said third predetermined maximum distance is less than one-half of said effective width.

16. The feeding mechanism according to claim 7, wherein saiud pair of said feed discs on said each feed shaft are centrally disposed within said effective width of said cutting machine.

17. The feeding mechanism according to claim 7, wherein said each feed disc has an effective radius less than said diameter.

* * * * *